United States Patent [19]

Welch et al.

[11] 4,307,805

[45] Dec. 29, 1981

[54] PACKAGING STRUCTURE

[75] Inventors: Jay V. Welch; Roy L. Miller, both of Winston-Salem, N.C.

[73] Assignee: Container Corporation of America, Chicago, Ill.

[21] Appl. No.: 245,054

[22] Filed: Mar. 19, 1981

[51] Int. Cl.[3] ..... B65D 85/00

[52] U.S. Cl. ..... 206/326; 206/44 R; 206/495; 206/586

[58] Field of Search ..... 206/326, 44 R, 44 B, 206/450, 491, 495, 472, 477, 482, 586; 229/43

[56] References Cited

U.S. PATENT DOCUMENTS

| | | | |
|---|---|---|---|
| 3,675,765 | 7/1972 | Melsek | 206/326 |
| 3,841,548 | 10/1974 | Curley | 206/472 |
| 3,992,849 | 11/1976 | Lett | 206/326 |
| 4,008,804 | 2/1977 | Poggiali | 206/326 |

*Primary Examiner*—Joseph Man-Fu Moy

*Attorney, Agent, or Firm*—R. W. Carpenter; Davis Chin

[57] ABSTRACT

A packaging structure for an article of furniture such as an end frame of a bed is disclosed.

1 Claim, 2 Drawing Figures

PACKAGING STRUCTURE

BACKGROUND OF THE INVENTION

1. Field of the Invention

This invention relates generally to packaging structures and more particularly, it relates to a combination bed headboard pack.

2. Description of the Prior Art

The prior art appears to be best exemplified in the following patents which were developed in a search directed to the subject matter of this application: U.S. Pat. Nos. 1,601,157 to Alleman et al. and 3,651,934 to Roberts et al.

SUMMARY OF THE INVENTION

The invention structure finds special application in the packaging of bedroom furniture such as the head or footboards of a bed.

Ordinarily, only part of such articles are finished, those ordinarily exposed to view, and it is a purpose herein to protect those surfaces of the article which are finished, while employing the unfinished surfaces as part of structure for maintaining the articles in position within the packaging structure.

DESCRIPTION OF THE PREFERRED EMBODIMENT

Figure 1:
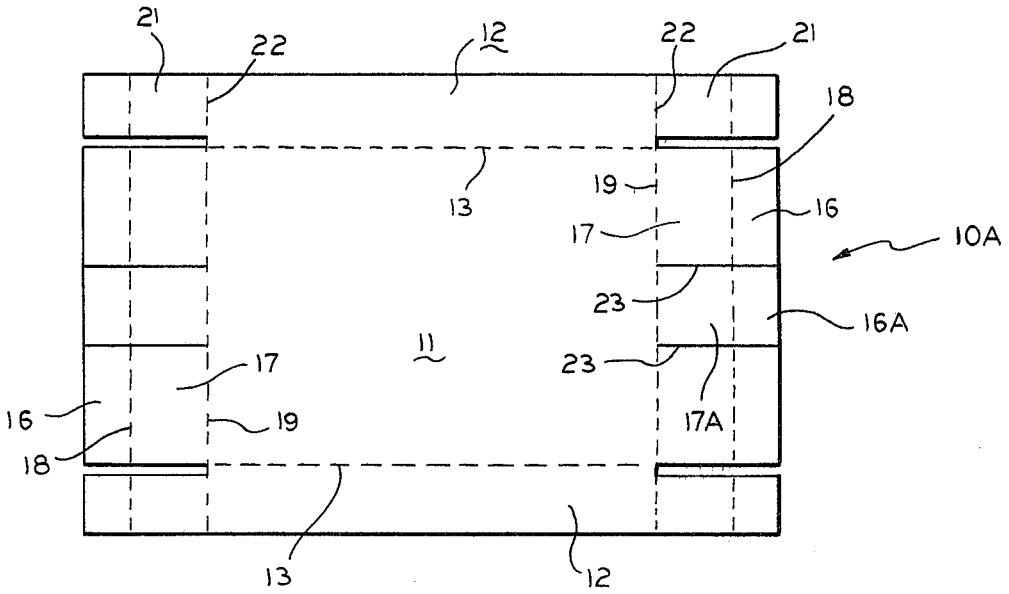
FIG. 1 is a plan view of cut and scored blank for forming a packaging structure according to the present invention.

The packaging structure according to the present invention is denoted by the reference numeral 10 and is formed from a cut and scored blank 10A of paperboard.

The packaging structure 10 is adapted to package a head or footboard HB forming part of a bed, not shown. Headboard HB comprises a pair of spaced vertical members VM spanned by an end member EM. In the usual case, headboard HB has only those parts finished which are visible where assembled into a bed. The remaining parts which are concealed lend themselves to affording points where the headboard HB can be secured in position within the structure 10.

The packaging structure 10 includes a rectangular base panel 11 closely approximating in size the article or headboard HB. Opposed side walls 12 are foldable with respect to base panel 11 along score lines 13 to erected position. End walls 14 extending from the opposed ends of base panel 11 are comprised of foldably joined outer and inner end wall elements 16 and 17 at fold line 18.

Inner end wall element 17 is foldable with respect to base panel 11 along fold line 19.

The side walls 12 have each end provided with flaps 21 foldable with respect thereto along fold lines 22. Flaps 21 are captured between the inner and outer end wall elements 17 and 16, and the assembly is maintained by staples S passing through flaps 21 and elements 16 and 17.

Each of the end walls 14 is separable into two fixed portions defined by spaced cut lines 23 extending transversely to the ends of base panel 11 and across the elements 16 and 17.

Flap portions between the spaced cut lines 16 and 17 are denoted 16A and 17A, and these flap portions are not stitched together but lie across the vertical members VM which lie closely to the end walls 14.

Figure 2:
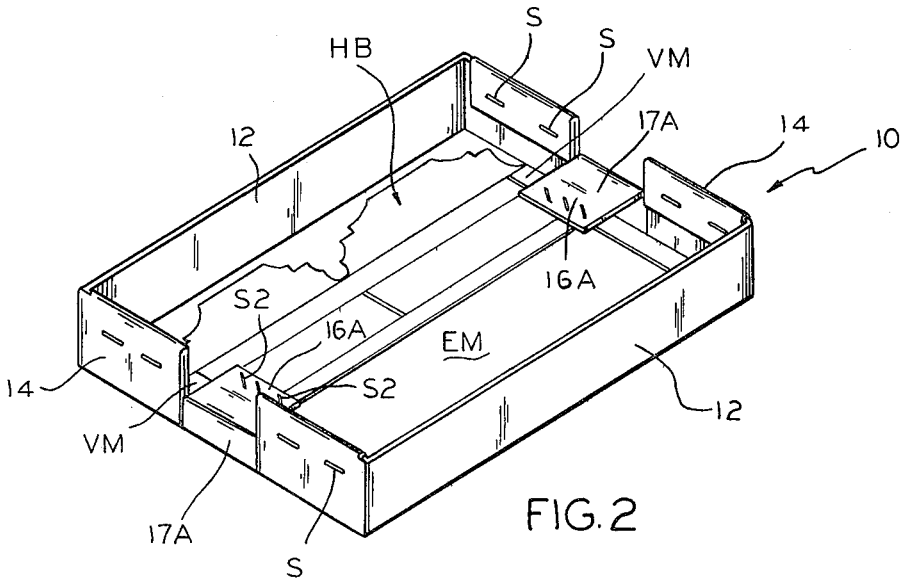
FIG. 2 is an isometric view of a packaging structure formed from the blank of FIG. 1, and showing an article of furniture packaged therein.

The articles or headboards HB are placed in position against base panel 11 with those parts of vertical members VM which are unfinished exposed. The flap portions 16A and 17A are then folded to position overlying members VM and are then stapled, glued or tacked to members VM, staples $S_2$ being shown in FIG. 2.

What is claimed is:

1. A packaging structure for an article of furniture such as head or footboards of a bed wherein such article includes spaced vertical members spanned by an end member, said packaging structure being for the purpose of maintaining said article in proper position during transportation thereof, said packaging structure being formed from a cut and scored blank of paperboard comprising:

(a) a rectangular base panel closely approximating the dimensions of said article;

(b) opposed side walls foldably connected to said base panels;

(c) opposed end walls comprised of foldably joined inner and outer end wall elements in confronting relationship, the outer wall elements being foldably connected to opposite ends of said base panel;

(d) said side walls having flaps extending from the ends thereof and captured between said inner and outer wall elements of said end walls;

(e) each of said end walls being separable into two fixed portions defined by spaced cut lines extending transversely to the ends of said base panel;

(f) flap portions comprised of inner and outer wall elements defined by said spaced cut lines and maintained in a relationship other than confronting and foldably connected to opposed ends of said base panel;

(g) each of said flap portions being folded over a vertical member of said article while resting on said base panel, and being secured to said vertical member.

* * * * *